US009300051B2

(12) United States Patent
Wong et al.

(10) Patent No.: US 9,300,051 B2
(45) Date of Patent: Mar. 29, 2016

(54) COMMUNICATION DEVICE WITH COUPLED-FED MULTIBAND ANTENNA ELEMENT

(71) Applicant: Acer Incorporated, New Taipei (TW)

(72) Inventors: Kin-Lu Wong, New Taipei (TW); Shan-Ni Hsu, New Taipei (TW)

(73) Assignee: Acer Incorporated, New Taipei (TW)

( * ) Notice: Subject to any disclaimer, the term of this patent is extended or adjusted under 35 U.S.C. 154(b) by 147 days.

(21) Appl. No.: 14/165,509

(22) Filed: Jan. 27, 2014

(65) Prior Publication Data

US 2015/0145738 A1 May 28, 2015

(30) Foreign Application Priority Data

Nov. 22, 2013 (TW) ..... 102142678 A

(51) Int. Cl.
*H01Q 9/04* (2006.01)
*H01Q 5/335* (2015.01)

(52) U.S. Cl.
CPC ..... *H01Q 9/0457* (2013.01); *H01Q 5/335* (2015.01)

(58) Field of Classification Search
CPC ... H01Q 5/0041; H01Q 9/0457; H01Q 5/328; H01Q 5/50; H01Q 13/08
USPC ..... 343/702, 893, 768, 770, 767, 700 MS, 343/745, 749
See application file for complete search history.

(56) References Cited

U.S. PATENT DOCUMENTS

| | | | | |
|---|---|---|---|---|
| 5,489,913 | A * | 2/1996 | Raguenet et al. | 343/767 |
| 2004/0140935 | A1* | 7/2004 | Korva | 343/700 MS |
| 2007/0080867 | A1* | 4/2007 | Son et al. | 343/700 MS |
| 2009/0174604 | A1* | 7/2009 | Keskitalo et al. | 343/700 MS |
| 2010/0045552 | A1* | 2/2010 | Ueki | 343/745 |
| 2011/0095949 | A1* | 4/2011 | Wong et al. | 343/702 |
| 2011/0273360 | A1* | 11/2011 | Campero et al. | 343/893 |
| 2013/0314283 | A1* | 11/2013 | Hong et al. | 343/700 MS |

* cited by examiner

*Primary Examiner* — Jean B Jeanglaude
(74) *Attorney, Agent, or Firm* — Jianq Chyun IP Office

(57) ABSTRACT

A communication device includes a ground element and an antenna element. The antenna element is disposed on a dielectric substrate which is adjacent to an edge of the ground element. The antenna element includes a radiating element, a shorting element and a feeding element. The radiating element has a first open end, a second open end and a shorting point. The radiating element is divided into a first element and a second element by the shorting point. The first element includes the first open end, and the second element includes the second open end. One end of the shorting element is coupled to the shorting point through a first inductive element, and another end is electrically connected to the ground element. The feeding element and the first element are spaced by a coupling gap, and the feeding element is coupled to a signal source through a matching circuit.

11 Claims, 4 Drawing Sheets

COMMUNICATION DEVICE WITH COUPLED-FED MULTIBAND ANTENNA ELEMENT

CROSS-REFERENCE TO RELATED APPLICATION

This application claims the priority benefit of Taiwan application serial no. 102142678, filed on Nov. 22, 2013. The entirety of the above-mentioned patent application is hereby incorporated by reference herein and made a part of this specification.

BACKGROUND OF THE INVENTION

1. Field of the Invention

The invention relates to a communication device; more particularly, to a communication device with a coupled-fed multiband antenna element.

2. Description of Related Art

In recent years, communication devices are manufactured in a way of not only providing functions but also focusing on designing appearances for the purpose of offering better video entertainment effects, so as to satisfy demands of consumers. In particular, after the narrow-frame design is incorporated into the communication devices, the visual effects thereof are presented in a more precise and more high-tech way. However, with the narrow-frame design, the thickness of the frame decreases, which makes the available space for the antenna elements become more and more limited. Hence, how to utilize the limited space to accommodate the antenna elements such that various communication services can be satisfied has become a major issue.

SUMMARY OF THE INVENTION

The invention provides a communication device having a small-sized coupled-fed multiband antenna element, and the antenna element has characteristics of a small size and a low profile, and contains a planar structure at the same time. Accordingly, the antenna element is suitable for being applied to a slim tablet communication device, and has characteristics of multiband operations to cover the LTE/WWAN bands.

The communication device of the invention includes a ground element and an antenna element. The antenna element is disposed on a dielectric substrate, and the dielectric substrate is adjacent to an edge of the ground element. The antenna element includes a radiating element, a shorting element and a feeding element. The radiating element has a first open end, a second open end and a shorting point. The radiating element is divided into a first element and a second element by the shorting point, wherein the first element includes the first open end, and the second element includes the second open end. One end of the shorting element is coupled to the shorting point through a first inductive element, and another end of the shorting element is electrically connected to the ground element. The feeding element and the first element are spaced by a coupling gap, and the feeding element is coupled to a signal source through a matching circuit.

To make the aforesaid features and advantages of the invention more comprehensible, several embodiments accompanied with figures are described in detail below to further describe the invention in details.

BRIEF DESCRIPTION OF THE DRAWINGS

The accompanying drawings are included to provide a further understanding of the disclosure, and are incorporated in and constitute a part of this specification. The drawings illustrate embodiments of the disclosure and, together with the description, serve to explain the principles of the invention.

DESCRIPTION OF EMBODIMENTS

Figure 1:
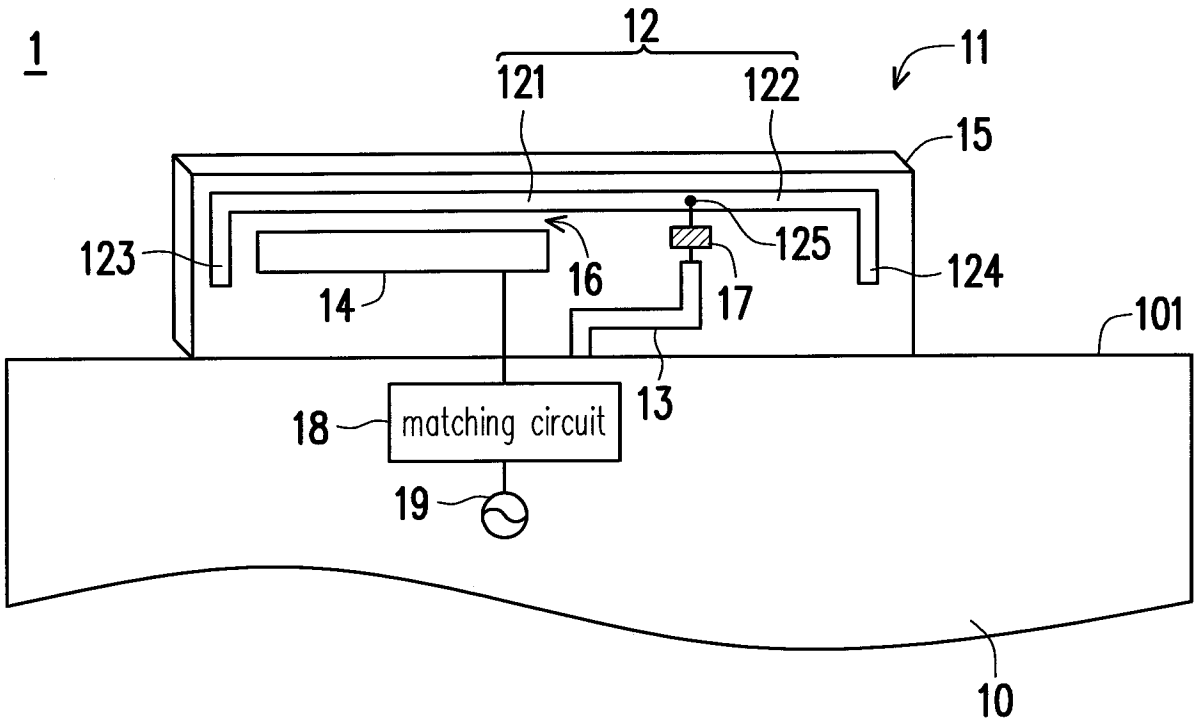
FIG. 1 is a schematic diagram illustrating a structure of a communication device according to an embodiment of the invention.

FIG. 1 is a schematic diagram illustrating a structure of a communication device according to an embodiment of the invention. A communication device 1 includes a ground element 10 and an antenna element 11. The antenna element 11 is disposed on a dielectric substrate 15. The dielectric substrate 15 is adjacent to an edge 101 of the ground element 10. The antenna element 11 includes a radiating element 12, a shorting element 13 and a feeding element 14. The radiating element 12 has a first open end 123, a second open end 124 and a shorting point 125. The radiating element 12 is divided into a first element 121 and a second element 122 by the shorting point 125. Namely, the shorting point 125 divides the radiating element 12 into the two elements 121 and 122.

The first element 121 includes the first open end 123. The second element 122 includes the second open end 124. One end of the shorting element 13 is coupled to the shorting point 125 through a first inductive element 17, and another end of the shorting element 13 is electrically connected to the ground element 10. The feeding element 14 and the first element 121 are spaced by a coupling gap 16. That is, the feeding element 14 is spaced from the first element 121 by the coupling gap 16. In addition, the feeding element 14 is coupled to a signal source 19 through a matching circuit 18. The radiating element 12 is substantially in an inverted U shape.

The antenna element 11 is operated in at least a first band and a second band, and frequencies of the first band are lower than frequencies of the second band. For example, the antenna element 11 receives a signal from the signal source 19 through the feeding element 14, and the signal from the feeding element 14 is coupled to the radiating element 12 through the coupling gap 16. In other words, the feeding element 14 excites the first element 121 and the second element 122 of the radiating element 12 through coupling. Under the excitation of the feeding element 14, the second element 122 provides a first resonant mode located in the second band. Furthermore, the feeding element 14 provides a second resonant mode located in the second band. Accordingly, an operating bandwidth of the second band can be greatly broadened with a combination of the first resonant mode and the second resonant mode.

On the other hand, the first element 121 is excited by the feeding element 14 through coupling, such that the first element 121 provides a third resonant mode located in the first band. Moreover, the matching circuit 18 allows the antenna element 11 to generate a fourth resonant mode located in the first band. Accordingly, an operating bandwidth of the first band can be greatly increased with a combination of the third resonant mode and the fourth resonant mode. Namely, in the present embodiment, an operating bandwidth of the antenna element 11 is increased with a combination of the coupling feed and the matching circuit 18, and further allowing the antenna element 11 to have characteristics of multiband operations. Additionally, the antenna element 11 further has characteristics of a small size and a low profile, and contains a planar structure at the same time. Therefore, in terms of practical applications, the antenna element 11 is suitable for being applied to a slim tablet communication device, such that the slim tablet communication device satisfies multiple communication services.

It is worth to note that lengths of the first element 121 and the second element 122 may be adjusted by selecting a position of the shorting point 125. For example, in an embodiment, the length of the second element 122 is at least 0.3 times the length of the first element 121. In addition, the first inductive element 17 and the shorting element 13 may be configured to reduce a resonant length of the first element 121 and the second element 122, and may also be configured to adjust a distribution of a resonant mode generated by the antenna element 11.

Figure 2:
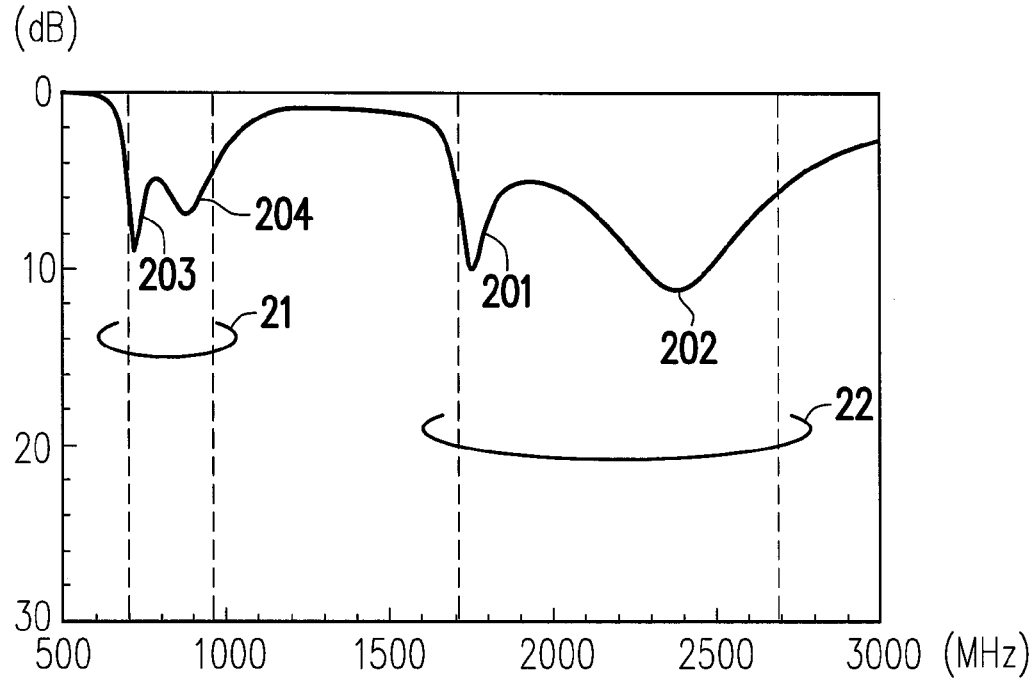
FIG. 2 is a diagram illustrating return loss of an antenna element according to an embodiment of the invention.

FIG. 2 is a diagram illustrating return loss of an antenna element according to an embodiment of the invention. In the present embodiment, a size of the ground element 10 is approximately 150×200 $mm^2$, which is the size of the ground element of a tablet communication device. The antenna element 11 has a size of approximately 10×40 $mm^2$ and is disposed on an FR4 dielectric substrate 15 having a thickness of 0.8 mm. Meanwhile, the first inductive element 17 is a chip inductor, and an inductance value thereof is approximately 18 nH. The length of the first element 121 is approximately 24 mm, while the length of the second element 122 is approximately 16 mm. A size of the coupling gap 16 is approximately 1 mm. The matching circuit 18 is a high-pass matching circuit.

As shown in FIG. 2, the antenna element 11 may be operated in a first band 21 and a second band 22, wherein a third resonant mode 203 and a fourth resonant mode 204 are located in the first band 21. In addition, with a combination of the third resonant mode 203 and the fourth resonant mode 204, a frequency range of the first band 21 is approximately 704 to 960 MHz and can cover the LTE700/GSM850/900 bands. On the other hand, a first resonant mode 201 and a second resonant mode 202 are located in the second band 22. Furthermore, with a combination of the first resonant mode 201 and the second resonant mode 202, a frequency range of the second band 22 is approximately 1710 to 2690 MHz and can cover the GSM1800/1900/UMTS/LTE2300/LTE2500 bands.

Figure 3:
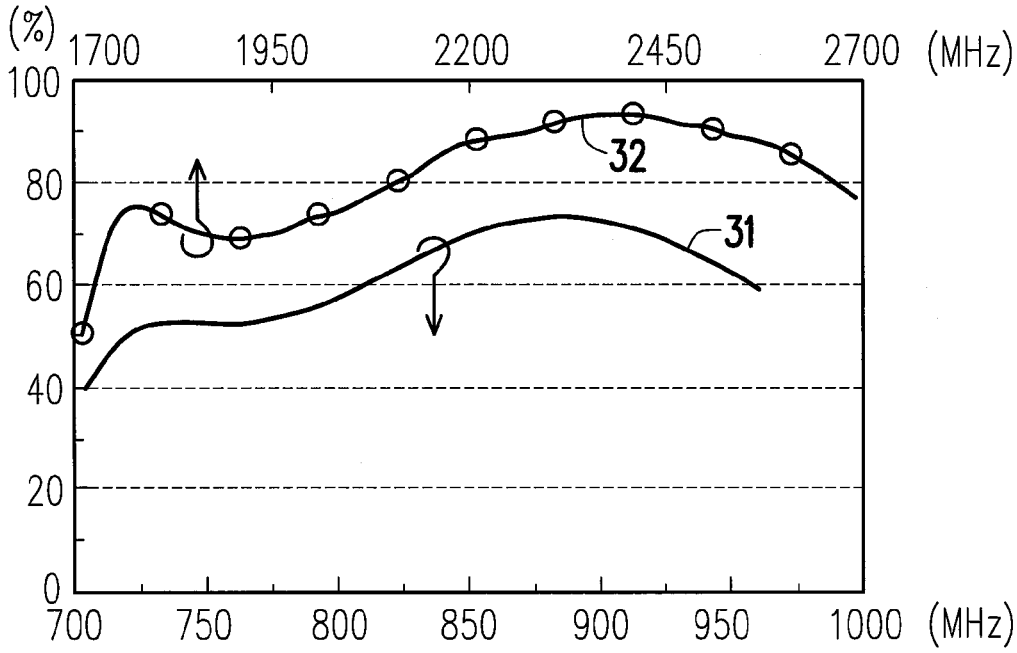
FIG. 3 is a diagram illustrating antenna efficiency of an antenna element according to an embodiment of the invention.

FIG. 3 is a diagram illustrating antenna efficiency of an antenna element according to an embodiment of the invention. In FIG. 3, an antenna efficiency curve represents the antenna efficiency of the antenna element 11 in the LTE700/GSM850/900 bands, an antenna efficiency curve 32 represents the antenna efficiency of the antenna element 11 in the GSM1800/1900/UMTS/LTE2300/LTE2500 bands, and the return loss is included in the antenna efficiency. As shown in FIG. 3, the antenna efficiency of the antenna element 11 in the LTE700/GSM850/900 bands is approximately 40 to 72%, and the antenna efficiency of the antenna element 11 in the GSM1800/1900/UMTS/LTE2300/LTE2500 bands is approximately 50 to 93%. In other words, the antenna efficiency of the antenna element 11 in each of operating bands meets the practical applications.

Figure 4:
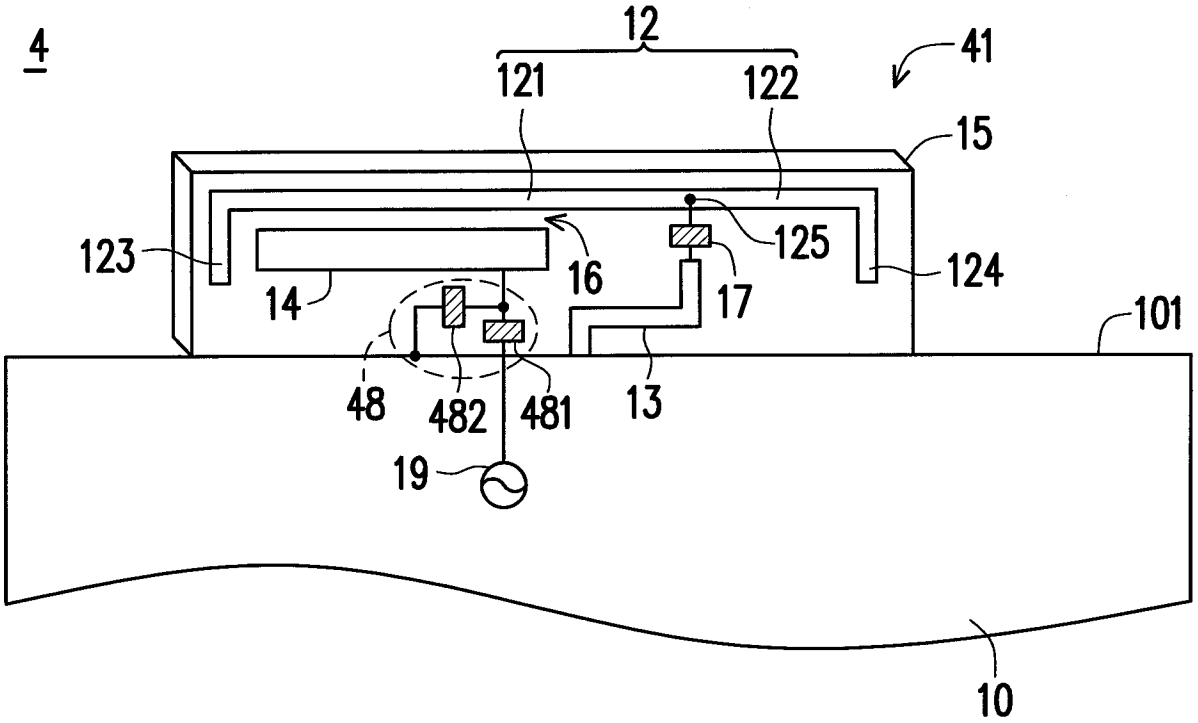
FIG. 4 is a schematic diagram illustrating a structure of a communication device according to another embodiment of the invention.

FIG. 4 is a schematic diagram illustrating a structure of a communication device according to another embodiment of the invention. A communication device 4 illustrated in FIG. 4 is basically similar to the communication device 1 illustrated in FIG. 1. The difference between the embodiment of FIG. 4 and the embodiment of FIG. 1 is that an arrangement of a matching circuit 48 of an antenna element 41 is different from that of the embodiment in FIG. 1. Specifically, the matching circuit 48 may be integrated on the dielectric substrate 15. Namely, the matching circuit 48 may be disposed in a clearance area of the antenna element 41. Furthermore, the matching circuit 48 includes a second inductive element 482 and a capacitive element 481. A first end of the capacitive element 481 is electrically connected to the signal source 19, and a second end of the capacitive element 481 is electrically connected to the feeding element 14. A first end of the second inductive element 482 is electrically connected to the second end of the capacitive element 481, and a second end of the second capacitive element 482 is electrically connected to the ground element 10. With this similar structure, the communication device 4 illustrated in the embodiment of FIG. 4 may also achieve effects similar to that in the embodiment of FIG. 1.

Figure 5:
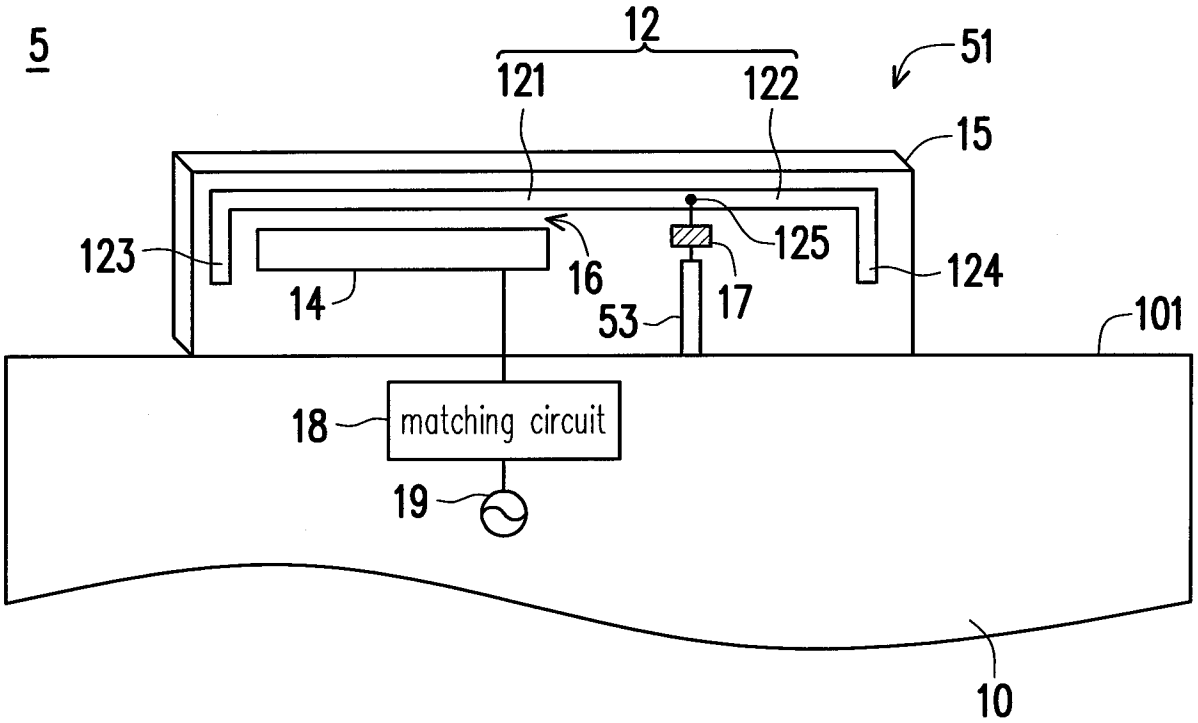
FIG. 5 is a schematic diagram illustrating a structure of a communication device according to yet another embodiment of the invention.

FIG. 5 is a schematic diagram illustrating a structure of a communication device according to another embodiment of the invention. A communication device 5 illustrated in FIG. 5 is basically similar to the communication device 1 illustrated in FIG. 1. The difference between the embodiment of FIG. 5 and the embodiment of FIG. 1 is that the radiating element 12 and a shorting element 53 in an antenna element 51 substantially form an inverted-E shape. In addition, similar to the embodiment illustrated in FIG. 1, the shorting point 125 may be configured to adjust lengths of the first element 121 and the second element 122. Moreover, the first inductive element 17 and the shorting element 53 may also be configured to reduce a resonant length of the first element 121 and the second element 122, so as to adjust a distribution of a resonant mode generated by the antenna element 51. With this similar structure, the communication device 5 illustrated in the embodiment of FIG. 5 may also achieve effects similar to that in the embodiment of FIG. 1.

It will be apparent to those skilled in the art that various modifications and variations can be made to the structure of the disclosed embodiments without departing from the scope or spirit of the invention. In view of the foregoing, it is intended that the disclosure cover modifications and variations of this specification provided they fall within the scope of the following claims and their equivalents.

What is claimed is:

1. A communication device, comprising:

a ground element; and an antenna element disposed on a dielectric substrate, the dielectric substrate being adjacent to an edge of the ground element, the antenna element comprising:

a radiating element having a first open end, a second open end and a shorting point, the radiating element being divided into a first element and a second element by the shorting point, the first element comprising the first open end, the second element comprising the second open end;

a shorting element having one end coupled to the shorting point through a first inductive element, and another end of the shorting element being electrically connected to the ground element; and a feeding element being coupled to a signal source through a matching circuit, and the feeding element and the first element being spaced by a coupling gap, wherein a signal from the feeding element is coupled to the radiating element through the coupling gap.

2. The communication device as claimed in claim 1, wherein the radiating element is substantially in an inverted-U shape.

3. The communication device as claimed in claim 1, wherein the radiating element and the shorting element substantially form an inverted-E shape.

4. The communication device as claimed in claim 1, wherein a length of the second element is at least 0.3 times a length of the first element.

5. The communication device as claimed in claim 1, wherein the matching circuit is a high-pass matching circuit, the high-pass matching circuit comprises a second inductive element and a capacitive element, a first end of the capacitive element is electrically connected to the signal source, a second end of the capacitive element is electrically connected to the feeding element, a first end of the second inductive element is electrically connected to the second end of the capacitive element, and a second end of the second capacitive element is electrically connected to the ground element.

6. The communication device as claimed in claim 1, wherein the matching circuit is located on the dielectric substrate or the ground element.

7. The communication device as claimed in claim 1, wherein the antenna element is operated in at least a first band and a second band, and frequencies of the first band are lower than frequencies of the second band.

8. The communication device as claimed in claim 7, wherein the second element provides a first resonant mode in the second band.

9. The communication device as claimed in claim 7, wherein the feeding element provides a second resonant mode in the second band.

10. The communication device as claimed in claim 7, wherein the first element provides a third resonant mode in the first band.

11. The communication device as claimed in claim 7, wherein the matching circuit allows the antenna element to generate a fourth resonant mode in the first band.

* * * * *